US005452792A

United States Patent [19]

Zautke et al.

[11] Patent Number: 5,452,792

[45] Date of Patent: Sep. 26, 1995

[54] CONTACT LENS CASE

[76] Inventors: Stephen Zautke, 312 S. Lomita St., Burbank, Calif. 91506; Daniella Kuhn, 357 Waverly Dr., Pasadena, Calif. 91105

[21] Appl. No.: 280,938

[22] Filed: Jul. 27, 1994

[51] Int. Cl.[6] ..... A45C 11/04

[52] U.S. Cl. ..... 206/5.1; 134/901

[58] Field of Search ..... 206/5.1, 534; 134/901; 116/308, 309

[56] References Cited

U.S. PATENT DOCUMENTS 2,177,978 10/1939 Darvie .
3,151,599 10/1964 Livingston ..... 116/308
3,818,858 6/1974 Kramer et al. .
4,011,829 3/1977 Wachsmann et al. ..... 116/308
4,345,541 8/1982 Villa-Real .
4,528,933 7/1985 Allen .
4,920,912 5/1990 Kirkling ..... 116/308
5,046,605 9/1991 Levrant ..... 206/5.1
5,280,834 1/1994 Berkley ..... 206/5.1

*Primary Examiner*—Jacob K. Ackun
*Attorney, Agent, or Firm*—Blakely, Sokoloff, Taylor & Zafman

[57] ABSTRACT

A contact lens case including a pair of container caps with timing mechanism for indicating when to perform a certain activity. These timing-keeping container caps comprising a cover and flange, one of which is rotatable to reference calendar days, month names or other time-related indicia.

19 Claims, 5 Drawing Sheets

*Figure 8*
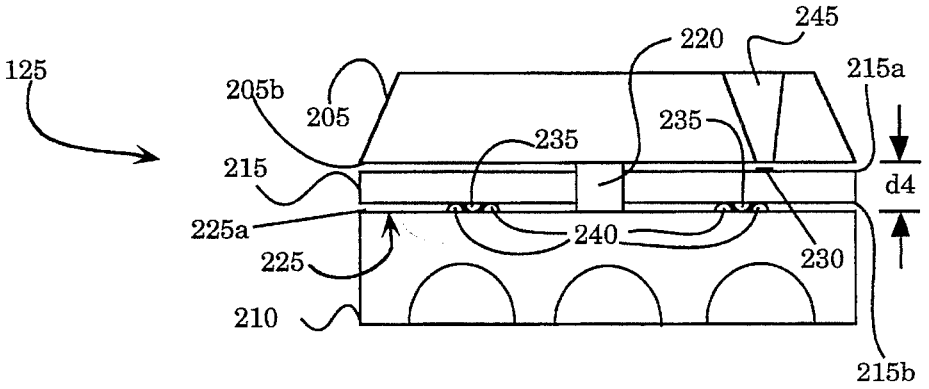
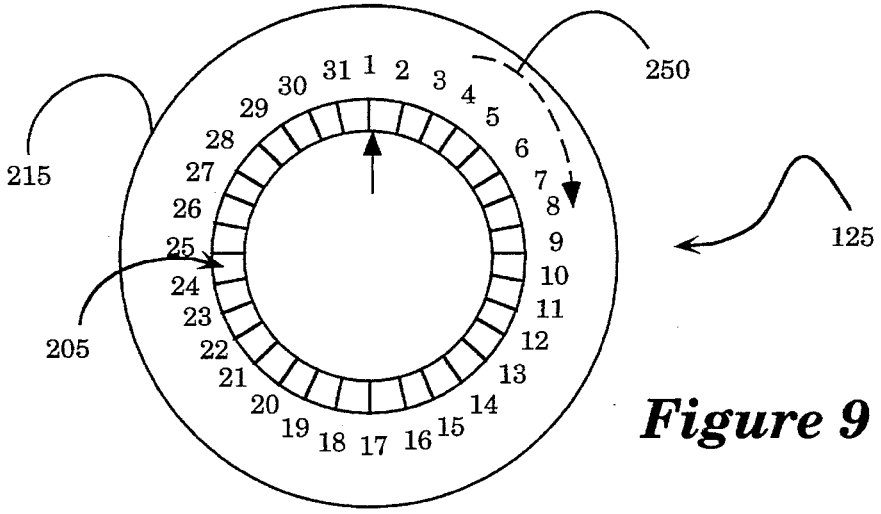
*Figure 9*
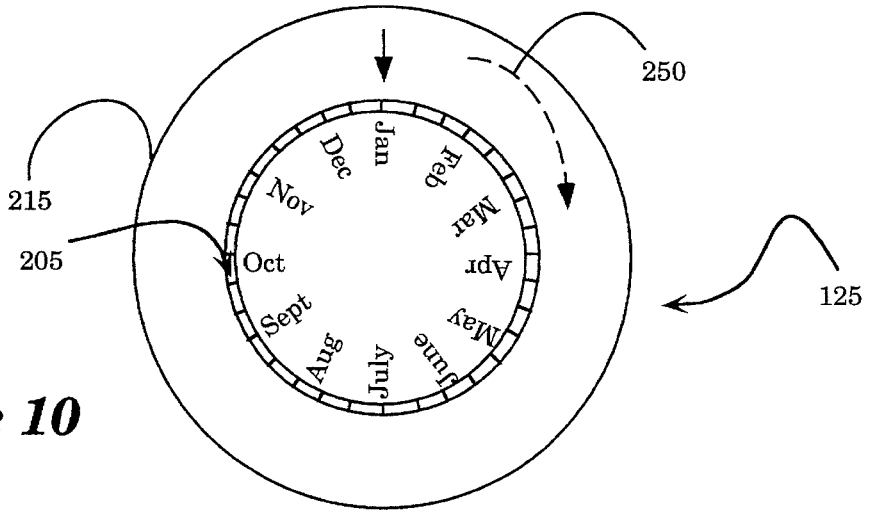
*Figure 10*

CONTACT LENS CASE

BACKGROUND OF THE INVENTION

1. Field of the Invention

The present invention relates to a device for storing time-dependent products. More specifically, the present invention relates to a contact lens case having a timing mechanism for reminding the contact lens wearer when to perform a certain event (enzyming, disposing, etc.).

2. Background of Art Related to the Invention

Over the last decade, contact lenses have become a popular option to persons having partially impaired vision, typically those persons who are near-sighted. A paramount reason for such popularity is that contact lenses are typically not as problematic as eyeglasses for many activities. For example, during recreational activities involving running, jumping or quick lateral movement, eyeglasses have a tendency of becoming fogged from changes in body temperature of the wearer or of being dislodged and possibly damaged. Another problem is that eyeglasses generally do not provide adequate peripheral vision which may be quite bothersome.

Currently, there are two types of contact lenses in the marketplace; namely, "hard" and "soft" contact lenses. The "soft" contact lenses are generally preferred since many contact lens wearers believe that they are more comfortable than "hard" contact lenses. Unfortunately, these "soft" contact lenses generally require a more thorough cleaning practice than that required for "hard" contact lenses. For example, one common task of this cleaning practice involves enzyming contact lenses after a predetermined time period, generally one week. If the cleaning practice is not consistently followed, the contact lens wearer becomes more susceptible to eye irritation and/or eye infections caused by bacteria, protein deposits and the like on the contact lenses.

For those contact wearers who are highly susceptible to eye irritation and/or infections or find this cleaning practice arduous, many contact lens manufacturers are beginning to market "disposable" soft contact lenses (hereinafter referred to as "disposable lenses"). A pair of disposable lenses are worn by the vision-impaired person for a predetermined number of days and thereafter, are thrown away and substituted with a new pair.

A common problem experienced by contact lens wearers of disposable and regular contact lenses is that he or she occasionally forgets to timely dispose of his or her disposable contact lenses, enzyme his or her contact lenses and other time critical practices. The lack of a timing mechanism in close proximity to the contact lens case increases the likelihood of the contact lens wearer forgetting to perform one or more of these practices, thereby increasing his or her chances of developing eye irritation and/or infection. There does not exist any device which is simple and solves the problems discussed above for contact lens wearers.

SUMMARY OF THE INVENTION

In light of the foregoing, it can be appreciated that there exists a need for a contact lens case including a timing mechanism for indicating when to perform a certain activity such as, for example, discarding disposable contact lenses, enzyming contact lenses and the like. Accordingly, it would be advantageous to provide a contact lens case having such a timing mechanism.

In general, the present invention comprises a contact lens case including a base which includes a pair of containers for storing contact lenses with a corresponding pair of container caps employing a timing mechanism (collectively referred to as a "time-keeping container cap"). These time-keeping container caps overlap the containers to prevent contaminates and unwanted materials from disinfecting the contact lenses. One embodiment of these time-keeping container caps comprises a cover rotatably coupled to a cylindrical flange completely enclosed at one end by a lid element. The cover and flange are coupled together by inserting an attachment pin, protruding from a bottom surface of the cover, through an aperture of the lid element so that the bottom surface of the cover is disposed on a top surface of the lid element. In this embodiment, time-related indicia (i.e., calendar days, abbreviated month names, days of the week, etc.) is printed on the top surface of the lid element and a time indicator (i.e., a precut opening, arrow, etc.) is cut through or printed on the cover for precise alignment with a selected portion of the indicia. Dimples deposited on the bottom surface of the cover and a top surface of the lid element to ensure precise alignment of the selected indicia and the time indicator for display purposes and prevent unwanted rotation of the cover.

Another embodiment of the time-keeping container caps includes a rotatable indicia plate interposed between a stationary cover and the stationary flange, all of which are coupled together through an attachment pin. The indicia plate remain rotatable between the stationary cover having a time indicator and flange by allowing a predetermined distance between the cover and a lid element of the flange. The predetermined distance is slightly greater than the thickness of the indicia plate. Time-related indicia is annularly positioned and printed on the indicia plate. Furthermore, by depositing dimples on a bottom surface of the indicia plate and a top surface of the lid element, or alternatively, on a top surface of the indicia plate and a bottom surface of the cover, precise alignment of the time indicator and the selected indicia as well as prevention of errant rotation of the indicia plate may be mitigated. Other embodiments of the present invention are contemplated and discussed below.

BRIEF DESCRIPTION OF THE DRAWINGS

The features and advantages of the present invention will become apparent from the following description of the present invention in which:

FIG. 8 is a cross-sectional view of a fourth embodiment of the first time-keeping container cap shown in FIGS. 1 and 2 including a rotatable number plate interposed between a stationary cover and stationary flange.

FIG. 9 is an overhead view of the fourth embodiment of the first time-keeping container cap, wherein the number plate, having a diameter greater than the diameter of the stationary cover, includes calendar dates for rotatable alignment with an arrow printed on the top surface of the cover.

FIG. 10 is an overhead view of a fifth embodiment of the first time-keeping container cap, wherein the number plate, having a diameter greater than the diameter of the stationary cover, includes an arrow printed on a top surface of the number plate which may be rotated for alignment with any one of a number of calendar dates annularly printed on the top surface of the cover.

DETAILED DESCRIPTION OF THE INVENTION

An apparatus is described for storing contact lenses and for indicating when to perform a certain activity such as cleaning or discarding one's contact lenses. In the following detailed description, dimples are defined as relatively small bumps, protrusions, or the like, which extend outwardly from the surfaces on which they are located. Furthermore, specific details of the present invention are set forth such as the dimension ranges of the components forming the present invention. It is apparent however, to one skilled in the art, that the present invention may be practiced while still deviating from these dimension ranges. Furthermore, it should be borne in mind that the present invention should not be limited solely in connection with contact lenses, but may be desirable in other related applications.

Figure 1:
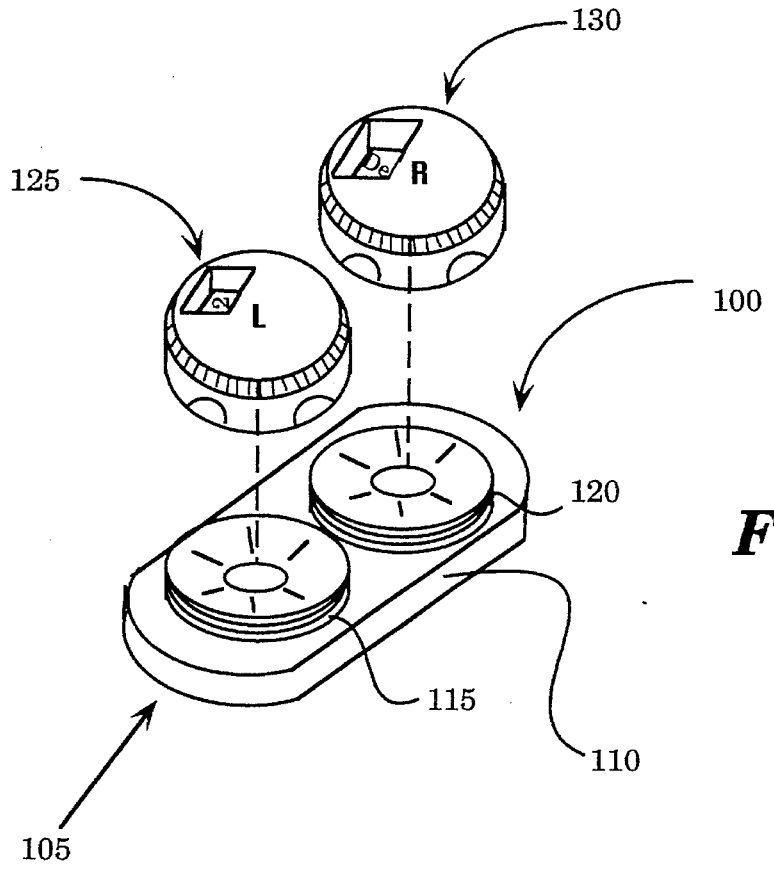
FIG. 1 is a perspective view of a contact lens case comprising a base including a pair of containers and a corresponding pair of time-keeping container caps, wherein each time-keeping container cap is being removed from its respective container.

Referring to FIG. 1, the present invention comprises a contact lens case 100 typically made of a molded plastic material or any other liquid impermeable material. The contact lens case 100 includes a base 105 having flat, oblong portion 110 and a molded pair of threaded containers 115 and 120. Each of the containers 115 and 120 is identical in physical construction, although it is appreciated that the containers 115 and 120 may be of different physical construction and/or nonthreaded. In this embodiment, the containers 115 and 120 are threaded and generally cylindrical in shape with a radius and height in the approximate range of 0.5 to 2.0 centimeters ("cm") and 0.5 to 1.50 cm, respectively. Moreover, an interior construction of the containers 115 and 120 may be cylindrically oriented or have a smooth, bowl-like orientation to prevent the contact lenses usually stored in a liquid disinfectant from being scratched when placed within or extracted from the containers 115 and 120.

Figure 2:
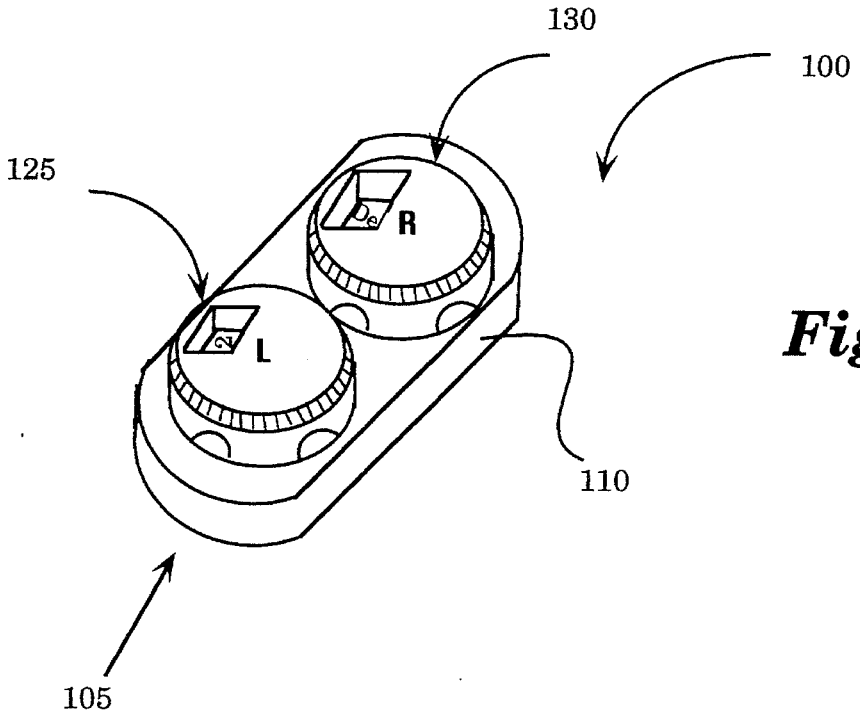
FIG. 2 is a perspective view of the embodiment of the contact lens case of FIG. 1, wherein each time-keeping container cap is securely affixed to its respective container.

The contact lens case 100 further comprises a first container cap having a timing mechanism (hereinafter collectively referred to as a "first time-keeping container cap") 125 and a second container cap having the timing mechanism (hereinafter collectively referred to as a "second time-keeping container cap") 130. Typically, both the first and second container caps 125 and 130 are made of molded plastic, each having a radius greater than the container radius so as to overlap and may completely envelop its respective container 115 or 120. Since the containers 115 and 120 are preferably identical, the time-keeping container caps 125 and 130 also are identical in construction and thus, can be securely coupled interchangeably to either of the containers 115 and 120. In this "closed" state, the time-keeping container caps 125 and 130 are in contact with a flat, top portion of the base 110 as shown in FIG. 2. In view of the fact that the first and second time-keeping container caps 125 and 130 are typically identical in construction but differ only by displaying different types of indicia (i.e., calendar dates, abbreviated and non-abbreviated months names, days of the week, etc.), for simplicity sake, only one of the time-keeping container caps, the first time-keeping container caps 125 for example, needs to be discussed.

Figure 3:
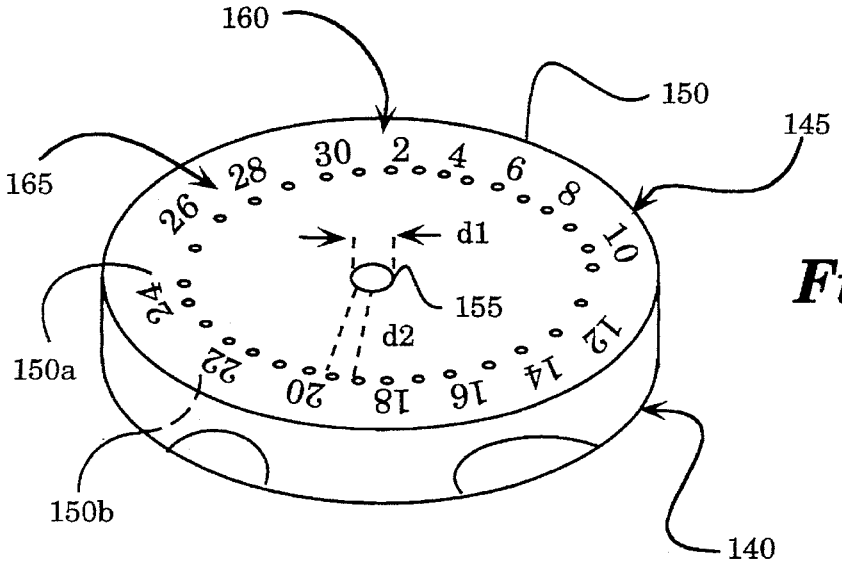
FIG. 3 is a perspective view of a flange for a first embodiment of a first time-keeping container cap shown in FIGS. 1 and 2 in which a lid element of the flange includes an aperture, "even" calendar dates annularly printed on a top surface of the lid element and a first plurality of dimples deposited on the top surface of the lid element to assist in properly aligning the cover for referencing one of the calendar dates.
Figure 4:
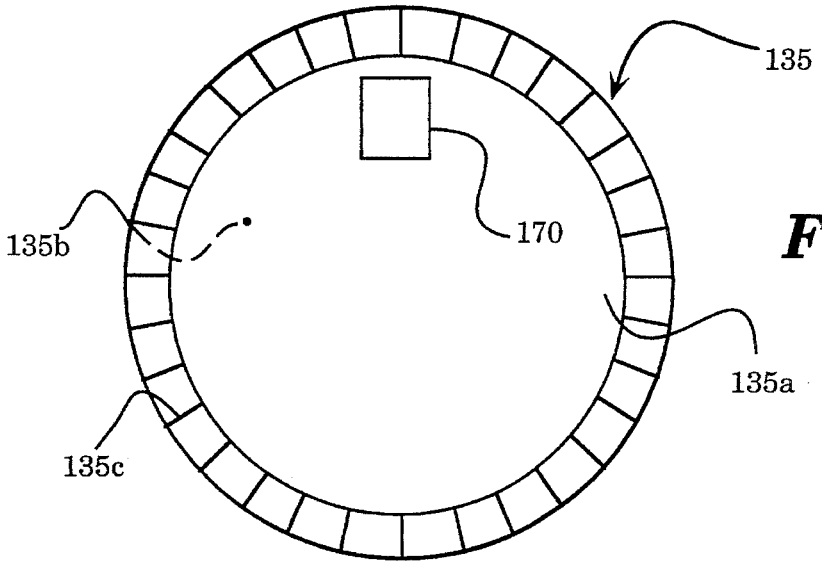
FIG. 4 is an overhead view of a top surface of a cover of the first time-keeping container cap which is rotatably coupled to the lid element shown in FIG. 3, wherein the cover, having a diameter equal to the diameter of the lid element, includes a precut opening sufficient in size to expose one of the "even" calendar dates.
Figure 5:
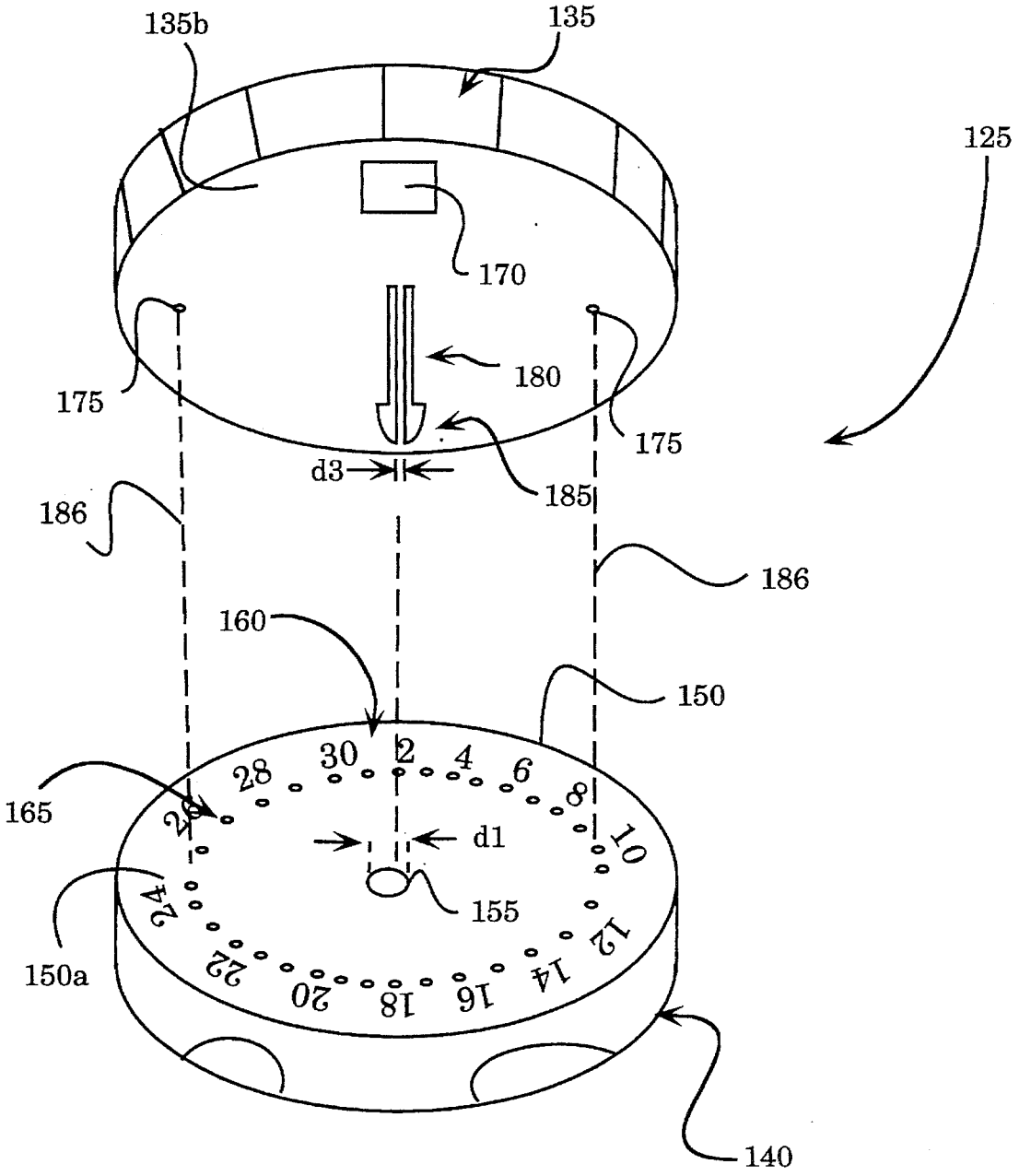
FIG. 5 is a perspective view of a bottom surface of the cover of FIG. 4 including an attachment pin and a second plurality of dimples being rotatably coupled to the flange of FIG. 3, wherein the attachment pin is inserted into the aperture of the lid element and each of the second plurality of dimples rests between two adjacent dimples of the first plurality of dimples for resisting unwanted rotation of the cover.

Referring to FIGS. 3–5, one embodiment of the first time-keeping container cap 125 includes a rotating cover 135 rotatably coupled to a stationary flange 140 having a substantially flat lid element 150 completely enclosing a first end 145 of the flange 140. As shown in FIG. 3, the flange 140 is cylindrical in shape having a radius greater than a radius its corresponding container and a height in the range of 0.50 cm to 1.50 cm. The lid element 150 is generally circular in shape (being approximately the cross-section of the flange 140) and includes a top and bottom surfaces **150*a* and 150*b* with an aperture 155 of a predetermined diameter "d1" in a range of 1–3 millimeters "mm") located proximate to its origin. The top surface 150*a* of the lid element 150 includes indicia 160, such as "even" calendar dates (for simplification in construction) printed in a desired annular orientation, and a first plurality of dimples 165 being a predetermined distance "d2" in the range of 2–15 mm from the aperture 155. The first plurality of dimples 165 are oriented equidistant or with varying distances from one another, provided such orientation enables viewing of a selected portion of the indicia 160, a particular calendar date for example, through the rotating cover 135 as discussed below. It is contemplated, of course, that the indicia 160** may include a variety of other time-related indicia, including but not limited to, odd calendar dates, all calendar dates, month names in abbreviated and non-abbreviated form, days of the week and the like.

Referring to FIG. 4, the cover 135 is a generally flat disk, preferably with a gradually downward sloping edge **135*c*, having a top and bottom surface 135*a* and 135*b* with a radius greater than the container radius and preferably identical to the radius of the flange 140 of FIG. 3. The cover 135 includes a precut opening 170 of sufficient area to allow the selected portion of the indicia 160 on the top surface 150*a* of the lid element 150 of FIG. 3 to be visible when aligned with the opening 170. The cover 135 further includes a second plurality of dimples 175 and an attachment pin 180 (shown in FIG. 5) formed on the bottom surface 135***b* of the cover 135.

Referring now to FIG. 5, the bottom surface 135*b* of the cover 135 is disposed on the top surface 150*a* of the lid element 150 so that the attachment pin 180, protruding from a center point of the cover 135, is inserted through the aperture 155 of the lid element 150. The attachment pin 180 includes a pair of protrusions 181 and 182 separated by a preselected distance "d3" (i.e., generally 0.5–2.0 millimeters) collectively forming an arrowhead-shaped attachment 185. The attachment 185 is slightly greater in size that the diameter "d1" of the aperture 155. When inserting the attachment 185 through the aperture 155, the separation distance "d3" decreases to allow the attachment 185 to pass through the aperture 155. Once the attachment 185 has passed through the aperture 155, the separation distance "d3" returns to normal, preventing removal of the attachment pin 180 back through the aperture 155.

Additionally, the bottom surface 135*b* of the cover 135 includes the second plurality of dimples 175 to operate in conjunction with the first plurality of dimples 165 to properly align the cover 135 with the flange 140 and to substantially prevent accidental rotation of the cover 135. More specifically, after inserting the attachment pin 180 through the aperture 155, each of the second plurality of dimples 175 rests between adjacent dimples of the first plurality of dimples 165 as indicated by dotted lines 186. By rotating the cover 135 to enable the opening 170 to expose another selected even calendar date, for example, the second plurality of dimples 175 would rest between different adjacent dimples of the first plurality of dimples.

Figure 6:
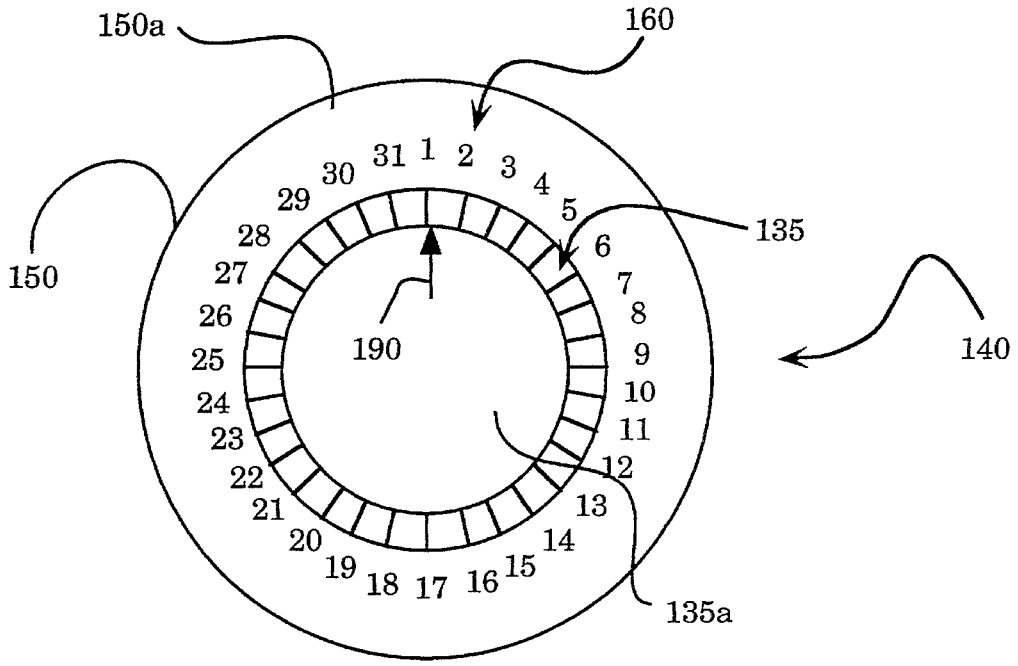
FIG. 6 is an overhead view of a second embodiment of the first time-keeping container cap, wherein the cover, having a diameter smaller than the diameter of the lid element, includes an arrow, printed on a top surface of the cover, being aligned to calendar dates annularly printed on the top surface of the lid element.
Figure 7:
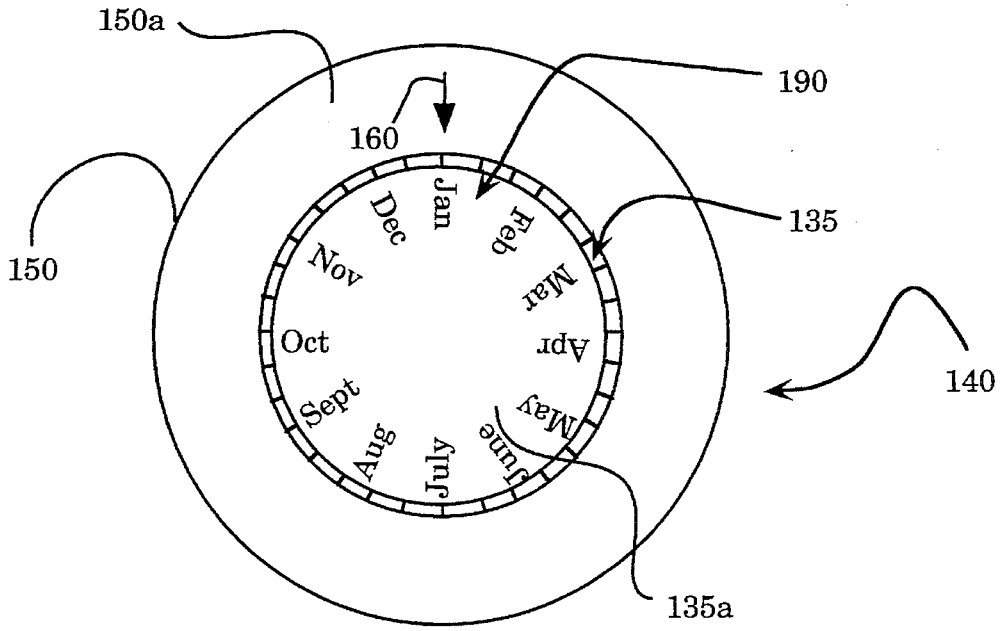
FIG. 7 is an overhead view of a third embodiment of the first time-keeping container cap, wherein the cover, having a diameter smaller than the diameter of the lid element, includes indicia being abbreviated month names annularly printed on the top surface of the cover for alignment with an arrow printed on the top surface of the lid element.

Referring to FIG. 6, another embodiment of the first time-keeping container cap is illustrated. In this embodiment, the first time-keeping container cap 125 operates in a fashion substantially similar to that disclosed in FIGS. 3–5. The only notables differences are that (i) the cover 135 is smaller in diameter than the flange 140 and (ii) the cover 135 does not include a precut opening. Instead, indicia 190 is printed on the top surface 135*a* of the cover 135 to operate in conjunction with the indicia 160 printed on the top surface 150*a* of the lid element 150. For example, the indicia 190 on the top surface 135*a* of the cover 135 may include an arrow, line or other time indicators, provided the indicia 160 on the top surface 150*a* of the lid element 150 is a month designation, day of the week, a calendar date ("even", "odd" or both as shown) or any other time-related indicia. Alternatively, the indicia 190 on the top surface 135*a* of the cover 135 may include the time-related information, provided the indicia 160 on the top surface 150*a* of the lid element 150 includes the time indicators like an arrow as shown in FIG. 7. By aligning the time indicator with the desired time-related indicia, a wearer could keep track of when to discard his or her contact lenses or to appropriately clean them. It is further contemplated that the cover 135 could be larger in diameter than the flange 140 while still using a precut opening as disclosed in FIGS. 4 and 5 by merely adjusting the first and second plurality of dimples and the indicia printed on the lid element.

Referring to FIG. 8, the first time-keeping container cap 125 includes a cover 205, a flange 210 and an indicia plate 215 interposed between the cover 205 and the flange 210. These components are coupled together in such a manner so that the cover 205 and the flange 210 are stationary and the indicia plate 215 is rotatable. This may be accomplished by securing an attachment pin 220 protruding from a bottom surface 205*b* of the cover 205 to a lid element 225 of the flange 210 in a manner as discussed above. However, one exception is that the attachment pin 220 is constructed to maintain a distance "d4" between a bottom surface 205*b* of the cover 205 and a top surface 225*a* of the lid element 225 of the flange 210. This distance "d4" is slightly greater than the thickness of the indicia plate 215.

Still referring to FIG. 8, the cover 205 and flange 210 are identical in physical construction to the cover 135 and flange 140 illustrated in FIGS. 3–7, except that a lid element of the flange 210 does not include time-related indicia. Instead, time-related indicia 230, being "even" calendar dates for example, is annularly positioned and printed on the indicia plate 215. Furthermore, by depositing a first plurality of dimples 235 on a bottom surface 215*b* of the indicia plate 215 and a second plurality of dimples 240 on the top surface 225*a* of the lid element 225 as shown, or alternatively, depositing the first plurality of dimples 235 on a top surface 215*a* of the indicia plate 215 and the second plurality of dimples 240 on a bottom surface 205*b* of the cover 205 (not shown). These dimples 235 and 240 enable proper viewing of the indicia 230 through a precut opening 245 of the cover 205 similar the embodiment of FIGS. 3–5 as well as mitigate erroneous rotation of the indicia plate 215.

Referring to FIGS. 9–10, other embodiments of the timing mechanism of the first container cap 125 of FIGS. 1 and 2 are illustrated which are substantially similar to those disclosed above and shown in FIGS. 6 and 7. The primary differences being, of course, that the indicia plate 215 is rotatable as shown by a broken arrow 250 while the cover 205 is stationary.

The present invention describe herein may be designed in many different configurations. While the present invention has been described in terms of various embodiments, other embodiments may come in mind to those skilled in the art without departing from the spirit and scope of the present invention. The invention should, therefore, be measured in terms of the claims which follow.

What is claimed is:

1. A contact lens case comprising:

a substantially horizontal base;

a plurality of containers coupled to said bore, each of said plurality of containers having an open end;

a plurality of flanges removably attached to said open ends of said plurality of containers to completely enclose said plurality of containers, said plurality of flanges including at least a first flange which includes an open first end and a second end closed by a corresponding lid element having an aperture cut therethrough and indicia printed on a top surface of said corresponding lid element; and a plurality of covers referencing said indicia printed on said top surface of said corresponding lid element, each of said plurality of covers being rotatably coupled to one of said plurality of flanges, wherein a first cover is coupled to said corresponding lid element by an attachment pin being coupled to a bottom surface of said corresponding lid element and inserted through said aperture.

2. The contact lens case according to claim 1 wherein said bottom surface of said first cover includes a first plurality of dimples annularly positioned proximate to a perimeter of said first cover, said first plurality of dimples working in cooperation with a second plurality of dimples deposited on said top surface of said corresponding lid element to enable said first cover to properly reference said indicia printed on said corresponding lid element.

3. The contact lens case according to claim 2 wherein said attachment pin includes an arrowhead shaped attachment.

4. The contact lens case according to claim 3, wherein said attachment pin includes a plurality of protrusions forming said arrowhead shaped attachment, said plurality of pro trusions being separated by a predetermined distance.

5. The contact lens case according to claim 4, wherein said corresponding lid element is generally circular in cross-sectional shape having a first diameter so that said indicia printed on said top surface of said corresponding lid element is annularly positioned around a perimeter of said corresponding lid element.

6. The contact lens case according to claim 5 wherein said first cover, being generally circular in cross-sectional shape having a second diameter approximately equal to said first diameter, includes a pre-cut opening for referencing said indicia printed on said corresponding lid element, wherein said indicia being time-related indicia consisting of calendar dates, abbreviated month names or days of the week.

7. The contact lens case according to claim 6, wherein said first cover, being circular in cross-sectional shape having a second diameter less than said first diameter of said corresponding lid element, includes time-related indicia printed on a top surface of said first cover and said top surface of said corresponding lid element.

8. A contact lens case comprising:

storing means for storing a pair of contact lenses, said storing means comprises a substantially horizontal base including a plurality of containers vertically protruding from said base;

cap means for substantially covering each of said plurality of containers to prevent said pair of contact lenses temporarily stored within said plurality of containers from being dislodged, said cap means includes a cylindrical flange having a first and second ends wherein said first end is completely enclosed by a substantially horizontal lid element, said lid element being generally circular in cross-sectional shape with a first diameter includes an aperture cut therethrough and indicia printed on a top surface of said lid element; and cover means for referencing said indicia printed on said top surface of said lid element, said cover means is rotatably coupled to said cap means by an attachment pin coupled to a bottom surface of said cover means, said attachment pin includes an arrowhead shaped attachment being inserted through said aperture of said lid element and prevented from being removed from said aperture.

9. The contact lens case according to claim 8 wherein said attachment pin includes a plurality of protrusions forming said arrowhead shaped attachment, said plurality of protrusions being separated by a predetermined distance.

10. The contact lens case according to claim 9, wherein said indicia is printed in an annular orientation about a perimeter of said lid element.

11. The contact lens case according to claim 10, wherein a bottom surface of said cover means includes a first plurality of dimples annularly positioned proximate to a perimeter of said cover means, said first plurality of dimples working in cooperation with a second plurality of dimples deposited on said top surface of said lid element to enable said cover means to properly reference said indicia printed on said lid element.

12. The contact lens case according to claim 11, wherein said cover means, being generally circular in cross-sectional shape having a second diameter approximately equal to said first diameter, includes a pre-cut opening for referencing said indicia printed on said top surface of said lid element, wherein said indicia is time-related indicia.

13. The contact lens case according to claim 11, wherein said cover means, being circular in cross-sectional shape having a second diameter less than said first diameter of said lid element, includes time-related indicia annularly printed on a top surface of said cover means while said indicia printed on said top surface of said lid element includes a time indicator.

14. The contact lens case according to claim 11, wherein said cover means, being circular in cross-sectional shape having a second diameter less than said first diameter of said lid element, includes a time indicator printed on a top surface of said cover means while said indicia, being time-related indicia printed on said top surface of said lid element.

15. A contact lens case comprising:

storage means for storing a pair of contact lenses, said storage means comprises a substantially horizontal base including a plurality of containers vertically protruding from said base;

cap means for substantially covering each of said plurality of containers to prevent said pair of contact lenses within said plurality of containers from being dislodged, said cap means includes a cylindrical flange having a first and second circular ends wherein said first end is completely enclosed by a substantially horizontal lid element, said lid element includes an aperture cut therethrough and indicia printed on a top surface of said lid element;

disk means for displaying indicia printed on a top surface of said disk means, said disk means, having a second aperture, is disposed on and rotatably coupled to said cap means by inserting an attachment pin through said second aperture; and cover means for referencing said indicia printed on said top surface of said disk means, said cover means is coupled to said cap means and said disk means through said attachment pin affixed to a bottom surface of said cover means, said attachment pin includes an arrowhead shaped attachment being inserted through said first and second apertures and prevented from being removed from said first aperture, whereas a distance between said bottom surface of said cover means and a top surface of said lid element is slightly greater than a thickness of said disk means.

16. The contact lens case according to claim 15, wherein said attachment pin includes a plurality of protrusions forming said arrowhead shaped attachment, said plurality of protrusions being separated by a predetermined distance.

17. The contact lens case according to claim 16, wherein said indicia, printed in an annular orientation on said disk means, includes one of a group consisting of calendar dates, abbreviated month names and days of the week.

18. The contact lens case according to claim 17, wherein a bottom surface of said cover means includes a first plurality of dimples annularly positioned proximate to a perimeter of said cover means, said first plurality of dimples working in cooperation with a second plurality of dimples deposited on said top surface of said disk means to enable said disk means to properly align said indicia printed on said disk means with a pre-cut opening on said cover means.

19. The contact lens case according to claim 18, wherein each cross-section of said cover means, disk means and said cap means is generally circular in shape and having equal diameter.

* * * * *